US008556091B2

(12) United States Patent
Cutler

(10) Patent No.: US 8,556,091 B2
(45) Date of Patent: Oct. 15, 2013

(54) DEVICE FOR HOLDING SHOWER ARTICLES

(75) Inventor: Charlyne Cutler, Las Vegas, NV (US)

(73) Assignee: Charlyne Cutler, Las Vegas, NV (US)

( * ) Notice: Subject to any disclaimer, the term of this patent is extended or adjusted under 35 U.S.C. 154(b) by 0 days.

(21) Appl. No.: 13/317,093

(22) Filed: Oct. 11, 2011

(65) Prior Publication Data

US 2013/0087520 A1 Apr. 11, 2013

(51) Int. Cl.
*A47G 29/087* (2006.01)
*F16B 45/00* (2006.01)

(52) U.S. Cl.
USPC ..... 211/119.009; 211/119.004; 248/394

(58) Field of Classification Search
USPC ..... 211/119.009, 119.011, 119.004, 113, 211/118, 87.01, 88.01, 89.01, 100, 106.01; 248/301, 303, 309.1, 304; 24/3.13
See application file for complete search history.

(56) References Cited

U.S. PATENT DOCUMENTS

| | | | | | |
|---|---|---|---|---|---|
| 2,157,024 | A * | 5/1939 | Smith | 15/220.4 |
| 2,576,303 | A * | 11/1951 | Matter | 312/206 |
| 4,978,043 | A * | 12/1990 | Uke | 223/88 |
| 4,998,647 | A * | 3/1991 | Sharp | 222/143 |
| D368,402 | S * | 4/1996 | Emery et al. | D6/525 |
| 5,954,288 | A * | 9/1999 | Shih | 242/380 |
| 6,216,319 | B1 * | 4/2001 | Elkins | 24/3.2 |
| 6,230,440 | B1 * | 5/2001 | Deutsch | 47/67 |
| 6,402,113 | B1 * | 6/2002 | Chang | 248/340 |
| 6,520,351 | B1 * | 2/2003 | Zadro | 211/119 |
| D477,947 | S * | 8/2003 | Snell | D6/525 |
| D494,794 | S * | 8/2004 | Winkleman | D6/525 |
| 7,594,305 | B2 * | 9/2009 | Moore | 24/299 |
| 7,887,017 | B2 * | 2/2011 | Moran | 248/339 |
| 7,931,160 | B2 * | 4/2011 | Newbouild et al. | 211/90.02 |
| 8,292,097 | B2 * | 10/2012 | Goldberg | 211/85.2 |
| 2003/0066938 | A1 * | 4/2003 | Zimmerman | 248/301 |
| 2003/0121871 | A1 * | 7/2003 | Zadro | 211/119 |
| 2005/0072886 | A1 * | 4/2005 | Adams | 248/301 |
| 2005/0236544 | A1 * | 10/2005 | Mancino et al. | 248/304 |
| 2007/0045208 | A1 * | 3/2007 | Quan | 211/119 |
| 2008/0222849 | A1 * | 9/2008 | Lavoie | 24/3.13 |
| 2010/0102014 | A1 * | 4/2010 | Yang | 211/113 |

* cited by examiner

*Primary Examiner* — Joshua J Michener
*Assistant Examiner* — Devin Barnett

(57) ABSTRACT

An updated version of the tradition shower caddy according to the present invention is designed to use retractable cords and removable clips as an aide to assist in storage of bathing/shower products instead of plastic racks or wire trays as used in traditional shower caddies. The device according to the present invention comprises an adjustable over-the-door hanger for the device to mount on a shower enclosure panel or door, at least one retractable reel and noncorrosive retractable cord attached to the over-the-door hanger, at least one removable clip attached to the retractable cord for securely holding shower articles such as shampoo, conditioner, body soap and the like, at least one hook for robe, body scrubber, and towels, and a soap dish. The present invention is also capable of hanging from the shower head pipe by repositioning the vertical strip which is attached to the "exterior hook" into a horizontal position, bringing the hook into an upright position, allowing the entire unit to suspend securely by the "Exterior Hook" from the common shower head pipe.

4 Claims, 10 Drawing Sheets

DEVICE FOR HOLDING SHOWER ARTICLES

BACKGROUND OF THE INVENTION

1. Field of the Invention

The present invention relates to a device for holding shower articles routinely used in bathroom showers. More particularly, the invention relates to a device utilizing retractable cords and removable clips as an aide to assist in storage of bathing/shower products such as shampoo, conditioner, body lotions, face wash, and the like.

2. Description of Related Art

A wide variety of holders or shower caddies for providing additional storage space for shower articles such as shampoo, conditioner, body lotion, tooth paste, and the like used in showers is known in the prior art. One type of shower caddy is designed to be hung on the shower enclosure panel or door. Another type of shower caddy is designed to be hung on a shower arm, or pipe of shower head. Most shower caddies are rigid plastic trays or wire racks. They all share the same shortcomings of being rigid and bulky. Therefore, they are not easily foldable or portable. Typical examples are shown in U.S. Pat. No. 4,541,131 to Sussman; U.S. Pat. No. 5,180,067 to Conaway et al.; U.S. Pat. No. 6,520,351 to Zadro; U.S. Pat. No. 6,581,790 to Zadro; U.S. Pat. No. 7,770,742 to Wagner et al. and U.S. PreGrant Publication No. 2008/0290055 to Perkovich.

To overcome these shortcomings, U.S. Pat. No. 5,351,346 to Hodges, Jr. discloses shower accessories comprising means for suspending the device from a shower head, a plurality of ropes connected to the suspending means, and fastening means for holding the shower articles to the ends of the ropes opposite the retaining means. The suspending means may be a loop of rubber or plastic or other suitable material which will grip the neck pipe of a shower head. The fastening means may be hooks or other fasteners suitable for detachably retaining bottles or tubes of shampoo, soap, lotion, etc. or other shower articles. In practice, specially designed tubes or bottles having a loop extending from the end of the tube or bottle opposite the cap may be used to contain the shampoo, soap, etc. A recognized problem with this invention is that it does not hold shampoo or conditioner in their original containers because original shampoo or conditioner bottles normally do not have a loop on the bottom to be hung on the hook of this accessory. Specially designed tubes or bottles having a loop extending from the end of the tube or bottle opposite the cap need to be used.

In addition, normally, after applying shampoo, a user may close eyes to avoid water or shampoo dripping into eyes. To put the shampoo back to the shower caddy or holder with eyes closed can be both inconvenient and annoying. Formerly there were no existing shower caddies or holders that solve this problem.

As a result, a need exists for a device for holding shower articles that is compact, lightweight, foldable, portable, and can suspend shower articles in their original containers in a bottom up position. Moreover, the device can suspend shower articles in a way that the user can simply grab the shower articles, use them and let go of the shower articles. The user need not remove the shower articles from the shower caddy for use and place them back after use.

SUMMARY OF THE INVENTION

In an exemplary embodiment of the present invention, there is disclosed a device for holding shower articles used in bathroom showers.

One object of the present invention is to provide a device for holding shower articles that is compact, lightweight, foldable, and portable.

Another object of the present invention is to provide a device for holding shower articles which can be hung on the shower enclosure panel or door.

A further object of the present invention is to provide a device for holding shower articles that can securely suspend shower articles in their original containers.

A still further object of the present invention is to provide a device for holding shower articles that can suspend shower articles in an inverted position, thus making it easier to extract the contents from the containers.

Yet another object of the present invention is to provide a device for holding shower articles that allows a user to use shower articles while they are still attached to the device; thus, the user need not remove or put back the shower articles from or to the shower article holder before and after use.

Still another facet of the present invention would be to use at least one hook making it capable of hanging the entire device from a shower head pipe as an alternative to the shower door panel.

An updated version of the traditional shower caddy is designed to use retractable cords and removable clips as an aide to assist in storage of bathing/shower products instead of plastic trays or wire racks as used in traditional shower caddies.

The device for holding shower articles according to the present invention comprises an adjustable over-the-door hanger for the device to mount securely on a shower enclosure panel or door, at least one retractable reel and noncorrosive retractable cord attached to the over-the-door hanger, at least one removable clip attached to the retractable cord for securely holding shower articles such as shampoo, conditioner, body soap and the like, at least one hook for robe, body scrubber, and towels, and a soap dish.

The aforementioned items are integrally molded or otherwise attached together. The over-the-door hanger is intended to hang on the shower door frame as opposed to shower pipe/fixture eliminating the weight on the plumbing, corrosion on the shower caddy unit, and the bulky unsightly nature of the shower caddy itself.

The removable clip has a snap hook at one end designed to attach to the retractable cord and a spiral cut anchor at the opposite end designed to easily penetrate through containers (for example, plastic bottles or tubes) commonly used for containing bathing products such as shampoo, conditioner, body soap, face wash, as example. The removable clip is screwed into the bottom of the product then reattached to the device of the present invention via retractable cord.

In the event the removable clips' anchor cannot penetrate the bottle, the hook has a hidden lance underneath the cap of said hook. This "lance cap" can be easily removed from the hook to initiate the guide hole for the removable clips/anchor to secure the product bottle, then the "lance cap" is easily replaced and secured on the hook until next desired.

In one embodiment, the over-the-door hanger, hooks, and soap dish are made of plastic or other suitable waterproof material.

An alternative embodiment of the device may also include other types of hooks such as removable "S" hooks.

The device for holding shower articles according to the present invention is compact, lightweight, foldable and portable.

The more important features of the invention have thus been outlined in order that the more detailed description that follows may be better understood and in order that the present contribution to the art may better be appreciated. Additional features of the invention will be described hereinafter and will form the subject matter of the claims that follow.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

The foregoing has outlined, rather broadly, the preferred feature of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention and that such other structures do not depart from the spirit and scope of the invention in its broadest form.

BRIEF DESCRIPTION OF THE DRAWINGS

Other aspects, features, and advantages of the present invention will become more fully apparent from the following detailed description, the appended claim, and the accompanying drawings in which similar elements are given similar reference numerals.

DESCRIPTION OF THE PREFERRED EMBODIMENT

Figure 1:
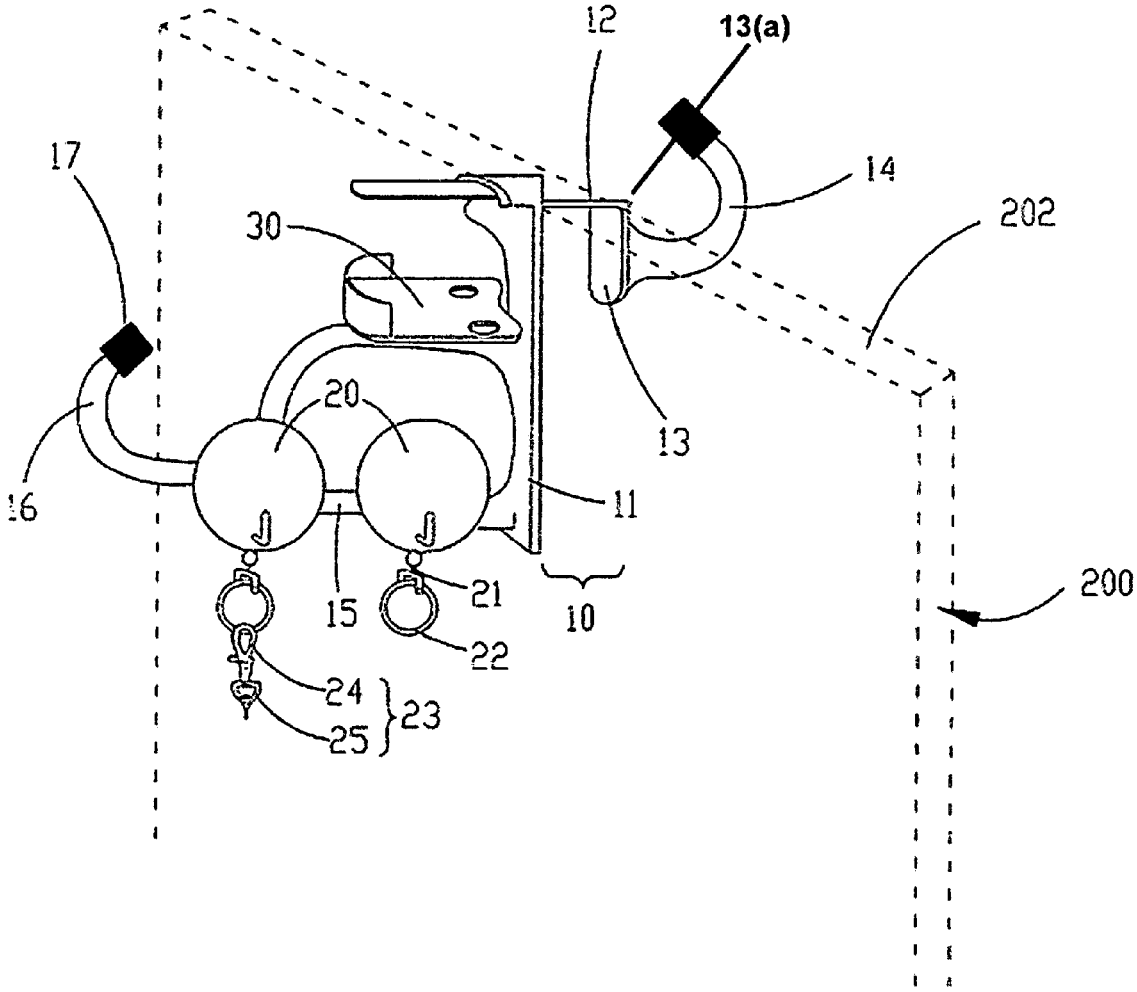
FIG. 1 is a perspective view of an embodiment according to the present invention.

Referring to the FIG. 1 for more detail, numeral 100 generally designates a device constructed according to one embodiment of the present invention. As shown in FIG. 1, the device 100 according to the present invention may be mounted on a shower enclosure panel or door 200 and more specifically, may be hung on an upper edge 202 of the shower door 200.

The device 100 includes an over the door hanger 10, which mounts on an upper edge 202 of a shower door 200. The hanger 10 has the shape of an inverted U and includes a vertical front strip 11, a horizontal top piece 12 extending rearwards from the upper edge of the vertical front strip 11, a vertical back strip 13 extending downwardly from the back edge of the top piece 12, and an up-turn hook 14 extending rearwards and upwardly from the vertical back strip 13. The horizontal top piece 12 is integrally molded or otherwise attached to the upper edge of the front strip 11; the back strip 13 is integrally molded or otherwise attached to the back edge of the horizontal top piece 12 at 13*a*; and the up-turn hook 14 is integrally molded or otherwise attached to the back strip 13. In use, the adjustable horizontal top piece 12 mounts on the upper edge 202 of a shower door 200 so that the vertical front strip 11 faces inside and the vertical back strip 13 faces outside of the shower door 200. Thus the up-turn hook 14 is called an exterior hook.

The lower end of the vertical front strip 11 is provided a horizontal arm 15, perpendicular to the vertical front strip, extending forwardly and providing connection portions for at least one retractable reel 20 and noncorrosive retractable cords 21. The retractable cord 21 has the first end residing inside the retractable reel 20 and the second end protruding out of the retractable reel 20, and has a ring 22 attached to aminal of its second end.

At the second end of each retractable cord 21 attached a ring 22 provides connection portion for a removable clip 23. A removable clip 23 has a snap hook 24 at one end designed to removably attach to the ring 22 on the retractable cord 21, and a spiral cut anchor 25 at the opposite end designed to easily penetrate through plastic containers 300 commonly used for containing bathing products such as shampoo, conditioner, body soap, face wash, etc.

Figure 2:
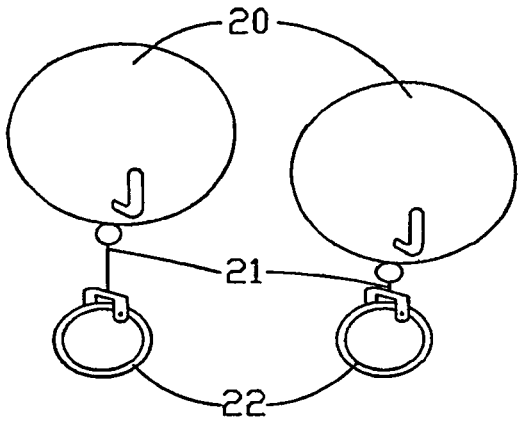
FIG. 2 is a close up view of a retractable cord reel and retractable cord before and after extraction.

As shown in FIG. 2, the retractable reel 20 allows for extraction and retraction of the retractable cord 21, the length of the retractable cord 21 can be pulled out for a distance of about 18 inches, more or less, and retracted to a distance of about one-half of an inch when at rest after being retracted (FIG. 2).

Figure 3:
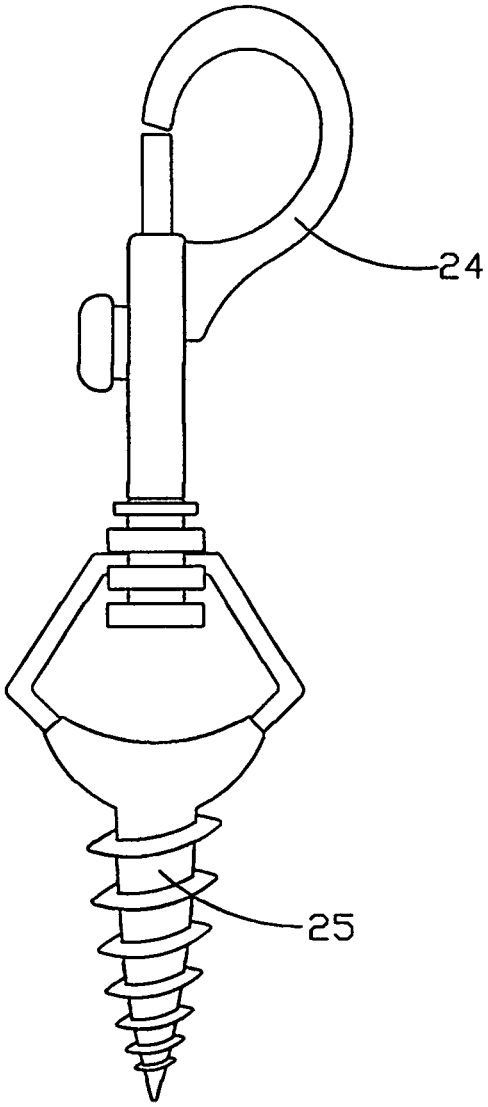
FIG. 3 is a close up view of a removable clip.

FIG. 3 depicts a zoom-in view of a removable clip 23, which has a snap hook 24 at one end and a spiral cut anchor 25 at the opposite end.

Figure 4:
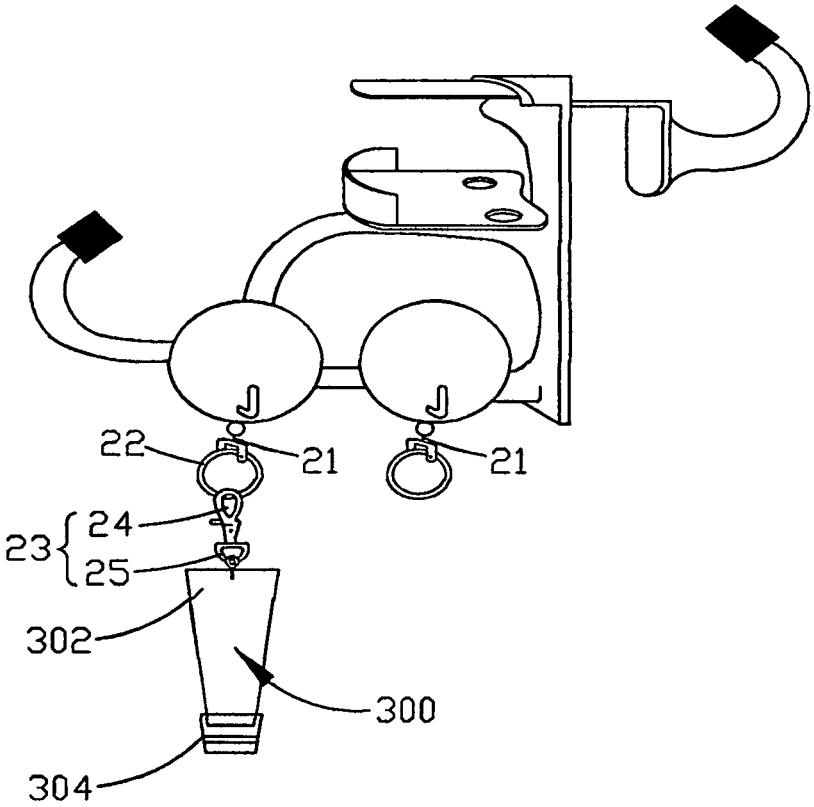
FIG. 4 is a perspective view of the embodiment of the invention shown in FIG. 1 being used to hold a shower product.

FIG. 4 demonstrates how a shower product 300 is held by the device 100. The spiral cut anchor 25 of removable clip 23 is screwed into the bottom 302 of the product container 300 then reattached to the ring 22 on the retractable cord 21 of the device 100 base via its snap hook 24. Therefore, this bottom up position enables a user to simply grab the product container 300, open the cap 304 and use without the need to remove the product from the device 100. The bottom up position also makes it easier to extract the contents from the product containers 300. The removable clip 25 together with the bathing product 300 may be removed from the retractable cord 21 and put away or used separately if preferred.

Referring now back to FIG. 1, the arm 15 past the connection portions for retractable cord reels 20 continuously extends forwardly and upwardly to form an up-turn hook 16, which is situated inside of the shower door 200, and thus is designed for hanging wash towel or body scrubber. The up-turn exterior hook 14 outside the shower door is designed for hanging drying towel or robe. The interior hook 16 has a hidden lance underneath the removable lance cap 17. In the event the removable clip's anchor 25 cannot penetrate the container 300, the lance cap 17 can be easily removed from the interior hook 16 to initiate the guide hole for the removable clips anchor 25 to secure the product bottle 300, and then the lance cap 17 is easily replaced and secured on the interior hook 16 until next use.

A soap dish 30 disposed perpendicularly to the vertical front strip 11, extending forwardly from about the midpoint of the vertical front strip 11 provides space for holding soap.

The device 100 of the present invention may further comprise at least one shelf or basket, a razor holder, and a fogless mirror.

Figure 5A:
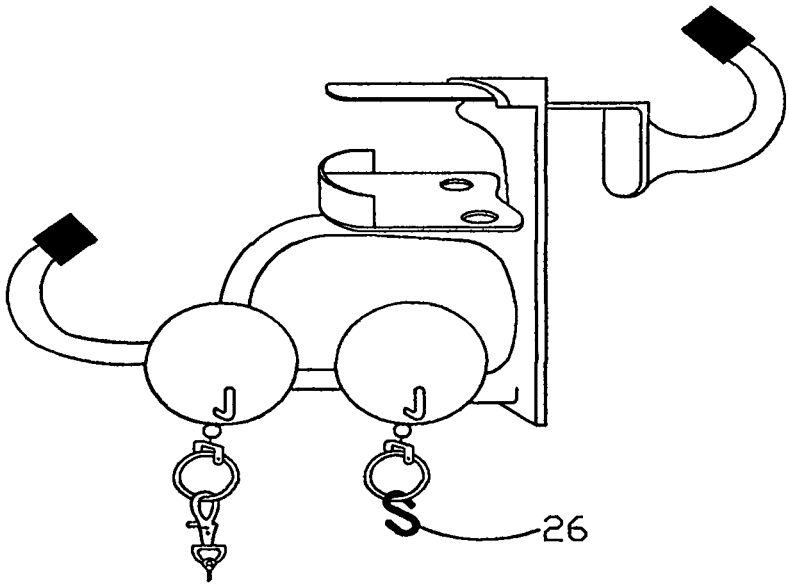
FIG. 5 A is a view of another embodiment of the invention wherein bathing shower products may be connected to a retractable cord with a removable "S" hook.
FIG. 5B is an enlarged view of a removable "S" type of hook.
Figure 5B:
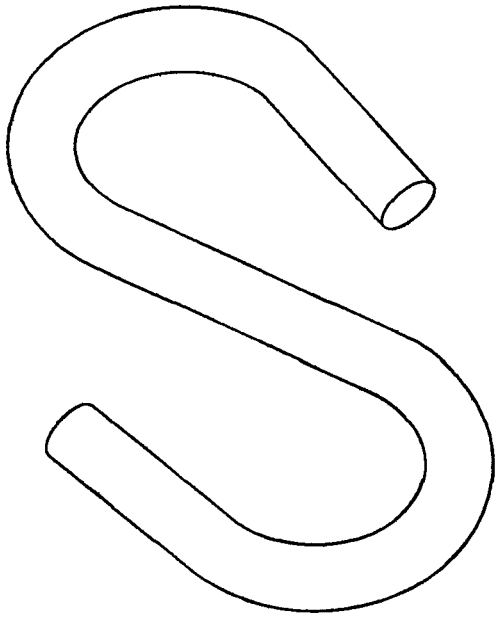
Figure 6:
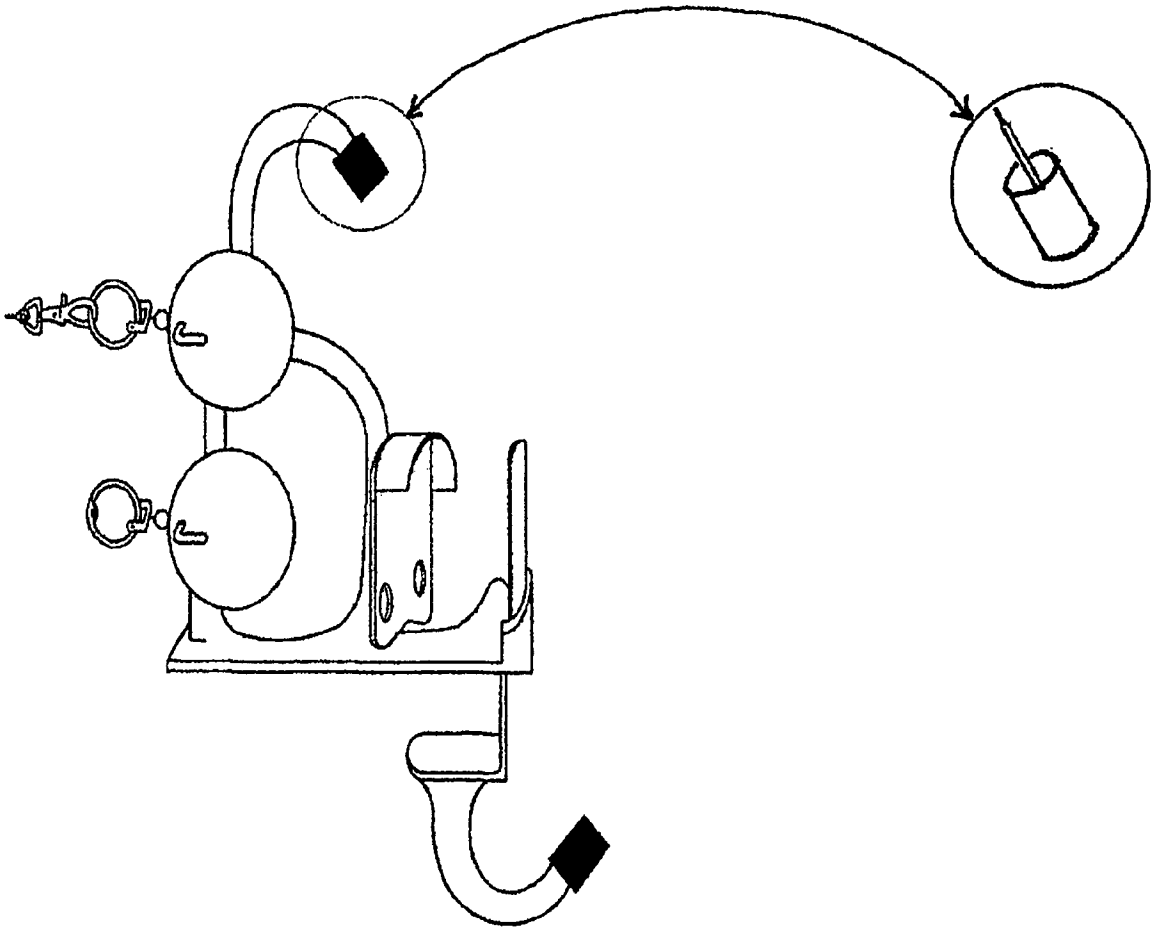
FIG. 6 is a close up view of a hidden lance cap.

An alternative embodiment of the device 100 is shown in FIG. 5A, wherein the means for connecting the bathing shower products to the retractable cord include other types of hooks such as a removable "S" hook 26. The zoom-in view of "S" hook is shown in FIG. 5B.

Figure 7:
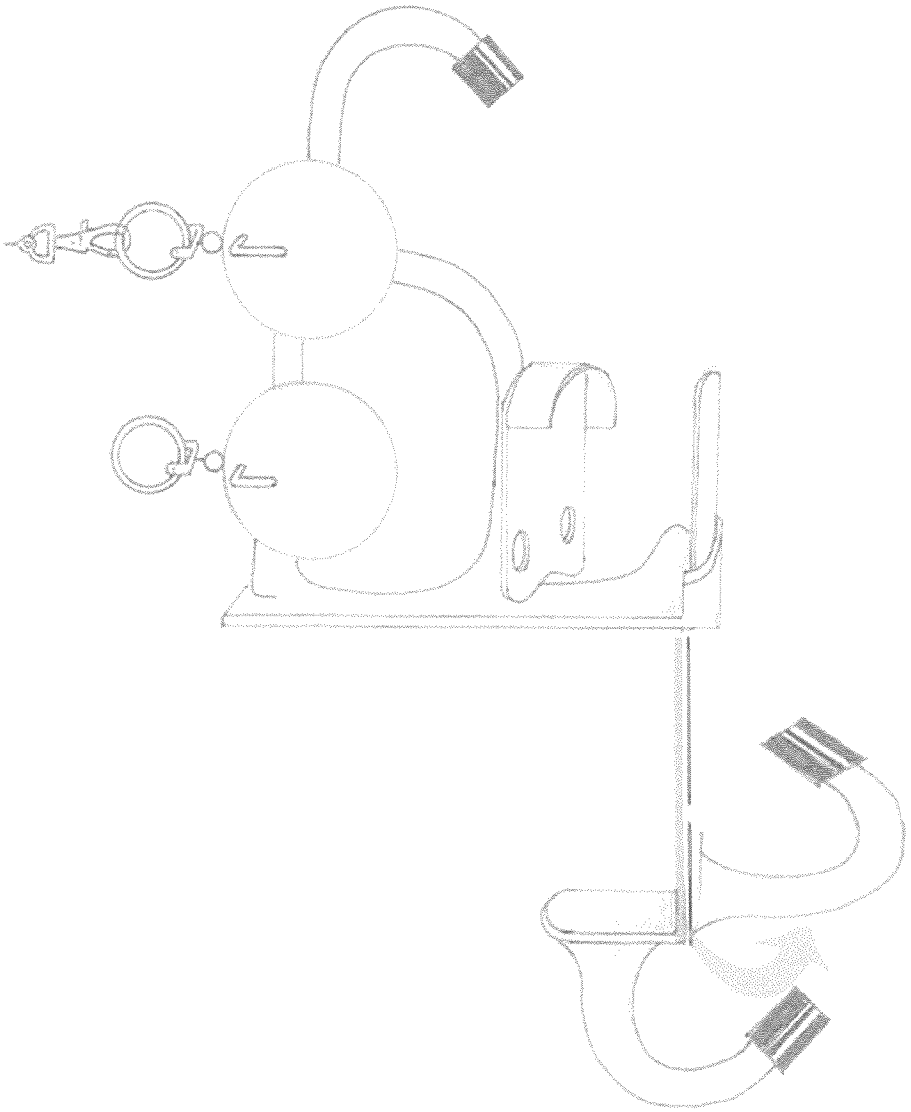
FIG. 7 is an illustration of the "exterior hook" (14) being repositioned into an upright stance

FIG. 7 is an illustration of the "exterior hook" (14) being repositioned into an upright stance by "flipping" the exterior vertical piece (13) by using the mechanisms built in to the location where (12) & (13) intersect (13*a*) into a horizontal position, rendering it even with the horizontal top piece (12).

Figure 8:
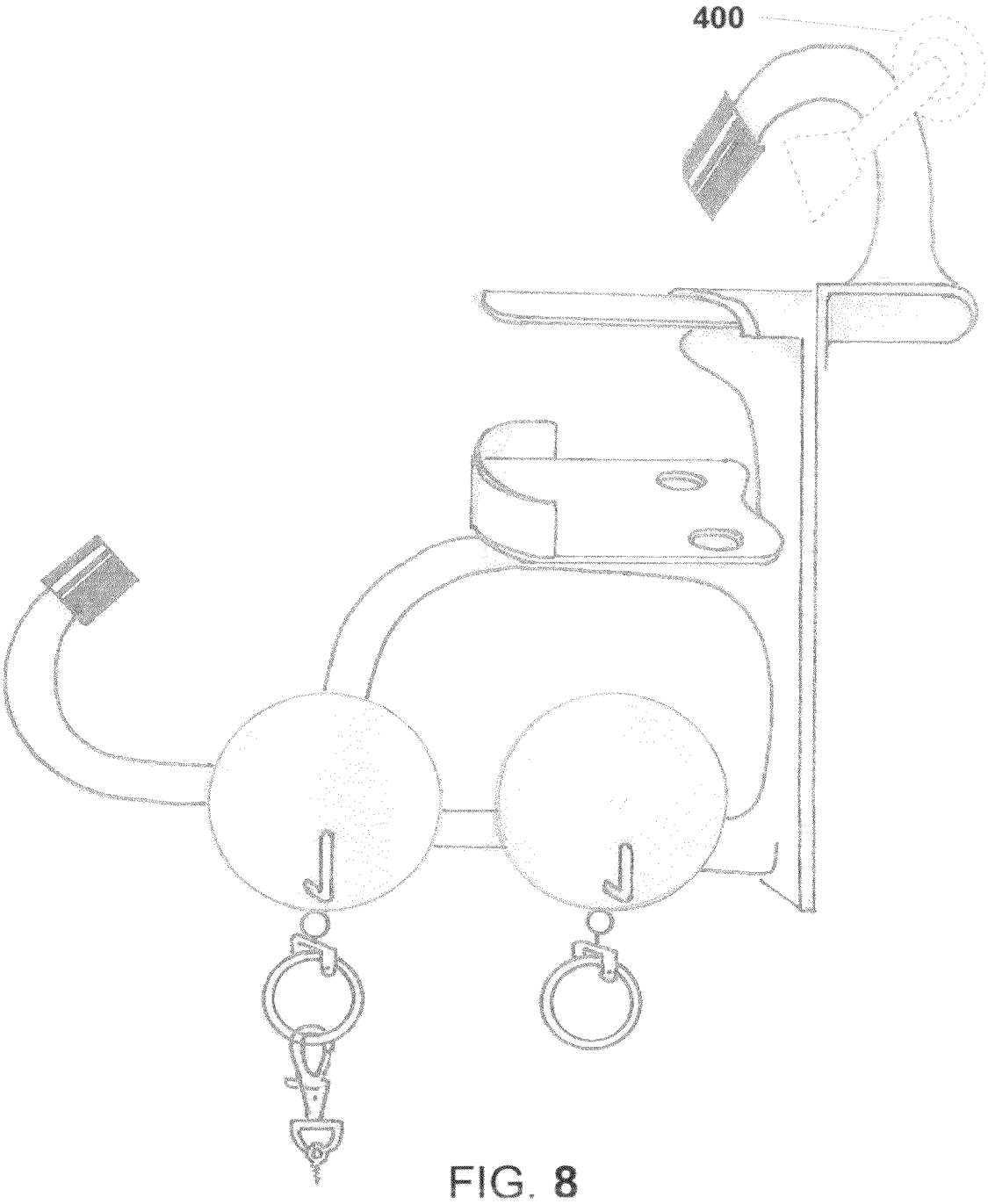
FIG. 8 represents the invention being hung from a traditional shower head pipe (400) after the "flip"
Figure 9:
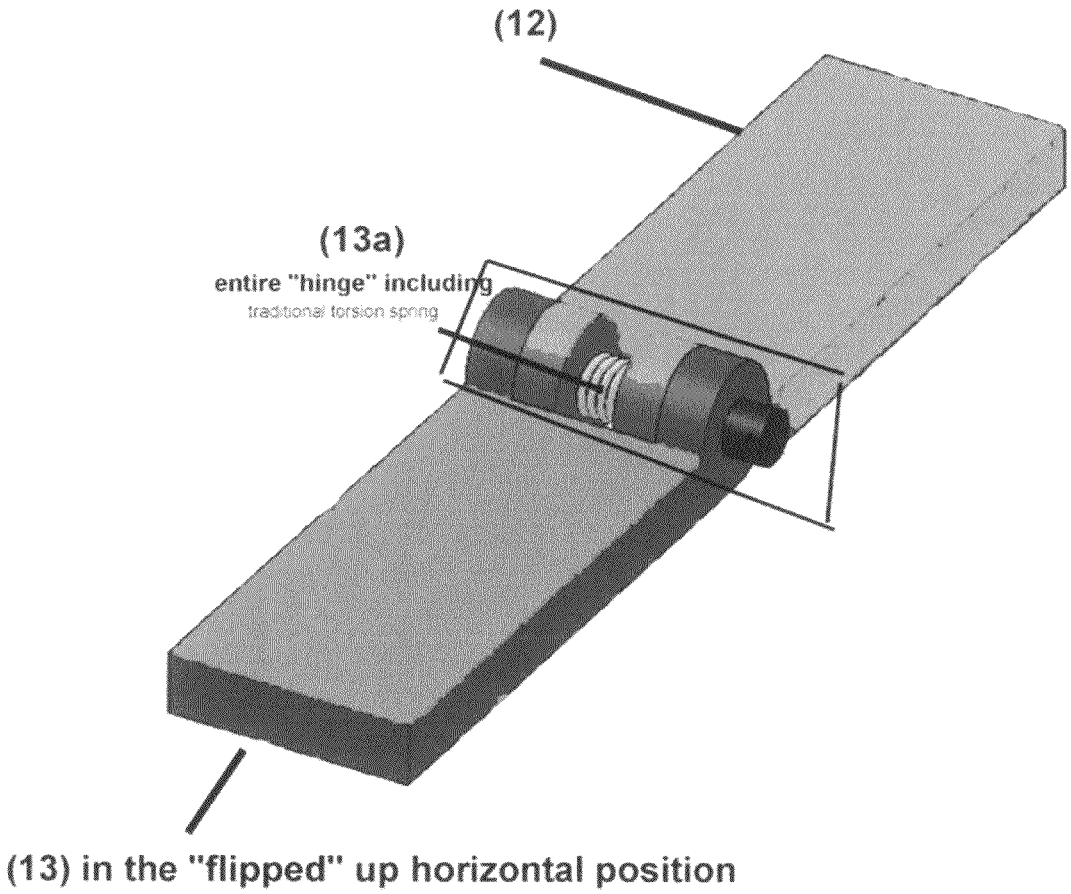
FIG. 9 is an illustrated close up view of (13*a*)

FIG. 8 represents the invention being hung from a traditional shower head pipe (400) after the "flip" has taken place and the adjustable top piece (12) has been slid to the middle of the present invention to aide in stability of the unit:

FIG. 9 is an illustrated close up view of (13*a*) showing a traditional spring (as invented and used by the Greek's in the early 1800's) being used to easily "flip" the "Exterior Hook" (14) which is attached to the exterior vertical piece (13) into an upright position allowing it to be used as an anchor to rest/suspend the present invention on to a shower head pipe (400) (as seen in (FIG. 8) if the user does not have a shower door frame to make use of.

While there have been shown and described and pointed out the fundamental novel features of the invention as applied to the preferred embodiments, it will be understood that the foregoing is considered as illustrative only of the principles of the invention and not intended to be exhaustive or to limit the invention to the precise forms disclosed. Obvious modifications or variations are possible in light of the above teachings. The embodiments discussed were chosen and described to provide the best illustration of the principles of the invention and its practical application to enable one of ordinary skill in the art to utilize the invention in various embodiments and with various modifications as are suited to the particular use contemplated All such modifications and variations are within the scope of the invention as determined by the appended claims when interpreted in accordance with the breadth to which they are entitled.

What is claimed is:

1. A device for holding shower articles comprising:

a. an over the door hanger for mounting on the shower door including a vertical front strip, a horizontal top piece integrally molded or attached to the upper edge of the vertical front strip, a vertical back strip integrally molded or attached to the rear edge of the horizontal top piece;

b. a horizontal arm disposed perpendicular to the vertical front strip extending forwardly being integrally molded or attached to the lower end of vertical front strip;

c. at least one retractable reel attached to the horizontal arm;

d. at least one noncorrosive retractable cord having a first end residing inside the retractable reel and a second end protruding out of the retractable reel, and having a ring attached to the terminal of the second end;

e. at least one removable clip having a snap hook at one end to connect with the ring on the retractable cord and a spiral cut anchor at the opposite end designed to penetrate through containers commonly used for containing bathing products;

f. at least one hook for storing a robe, body scrubber, or towel; and g. a soap dish disposed perpendicular to the vertical front strip, integrally molded or attached to the vertical front strip; wherein the soap dish rest upon an oval shaped member that is integrally connected to the horizontal arm.

2. The device for holding shower articles of claim 1, wherein the retractable reel allows for extraction and retraction of the retractable cord.

3. The device for holding shower articles of claim 2, wherein the length of the retractable cord can be up to 18 inches, when extracted and one-half of an inch, when at rest after retracted.

4. The device for holding shower articles of claim 1, wherein the at least one hook has a lance cap, which can be easily removed from the hook to initiate the guide hole for mounting the at least one removable clip to the horizontal arm.

* * * * *